US005553462A

United States Patent [19]

Taylor

[11] Patent Number: 5,553,462

[45] Date of Patent: Sep. 10, 1996

[54] DEHUMIDIFIERS

[75] Inventor: Simon A. Taylor, Bishop Auckland, Great Britain

[73] Assignee: Ebac Limited, United Kingdom

[21] Appl. No.: 404,091

[22] Filed: Mar. 14, 1995

[51] Int. Cl.[6] ..... F25D 21/06

[52] U.S. Cl. ..... 62/155; 62/156; 62/234

[58] Field of Search ..... 62/156, 155, 234, 62/82, 282, 229, 176.1, 176.2, 176.5, 176.6; 236/44 R, 44 A, 44 C

[56] References Cited

U.S. PATENT DOCUMENTS

| | | | |
|---|---|---|---|
| 4,302,947 | 12/1981 | Mueller et al. | 62/156 X |
| 4,328,680 | 5/1982 | Stamp, Jr. et al. | 62/234 X |
| 4,344,294 | 8/1982 | Gelbard | 62/156 X |
| 4,745,766 | 5/1988 | Bahr | 62/234 X |
| 5,493,870 | 2/1996 | Kodama et al. | 62/155 |

*Primary Examiner*—Harry B. Tanner
*Attorney, Agent, or Firm*—Ira S. Dorman

[57] ABSTRACT

Air drawn in by a fan 4 is cooled by evaporator coils 2 and re-warmed by a condenser 3. A microcontroller MC and sensor S reads the temperature of the incoming air at regular intervals, e.g. once every minute, and controls a compressor 1 to operates in successive run periods, during which the evaporator 2 removes moisture from the air, separated by defrost periods in which the compressor is switched off so that warm incoming air melts any ice on the evaporator. The temperature at the start of a run period determines the duration of the respective run period, and the temperature at the end of a run period determines the length of the following defrost period. The length of the run period is constant at low temperatures but increases to a longer constant period at higher temperatures. The length of the defrost period is a maximum close to freezing point, but is reduced by decreasing increments as air temperature increases. At higher temperatures the dehumidifier operates continuously with no defrost.

9 Claims, 1 Drawing Sheet

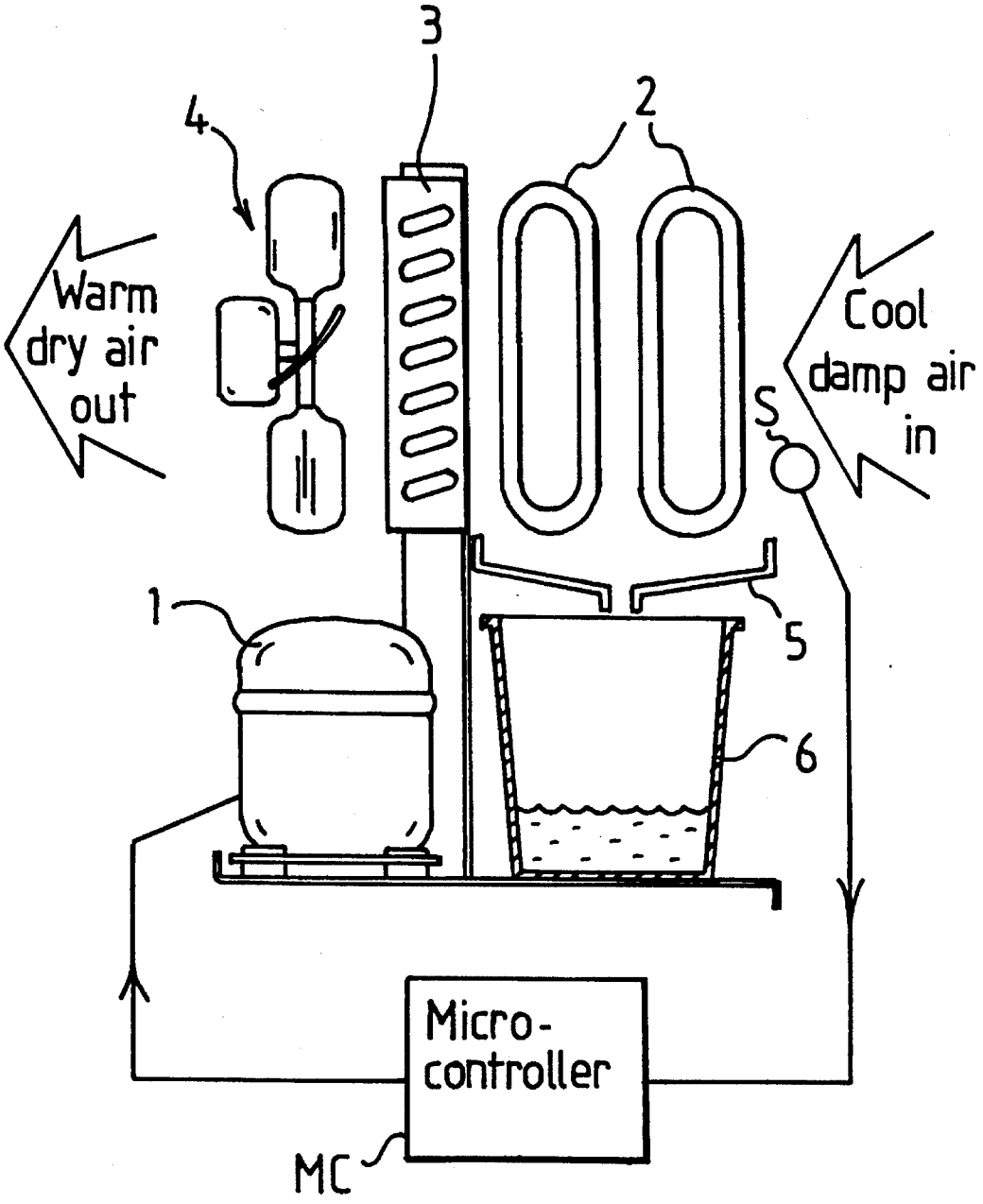
3
2
4
Warm
dry air
out
Cool
damp air
in
S
1
5
6
Micro-
controller
MC

DEHUMIDIFIERS

TECHNICAL FIELD OF THE INVENTION

This invention relates to dehumidifiers for extracting moisture from the air in a building.

More specifically, the invention is concerned with dehumidifiers in which a refrigerant is circulated by a compressor through an evaporator, which becomes cold, and a condenser, which becomes warm, and air is passed over the evaporator so that any moisture in the air condenses on the evaporator, following which the air passes over the condenser to be warmed before leaving the dehumidifier. Such dehumidifiers will be referred to below as "a dehumidifier of the kind set forth".

BACKGROUND

Dehumidifiers of the kind set forth are commonly used to reduce dampness or condensation in a building.

The water that collects on the evaporator may freeze, but the dehumidifier periodically enters a defrost mode which allows the ice to melt. The water is collected in a water container, which usually includes a float switch that switches off the dehumidifier when the container is full. The defrost mode can be achieved in several ways:

1. A passive defrost system is sometimes used, in which the compressor is switched off for a fixed period every hour, i.e. there is a set running period and a set defrost period. The fan which draws air through the dehumidifier continues to run during the defrost period so that the incoming, relatively warm air eventually melts any buildup of ice on the evaporator.

2. In other cases a defrost heater may be included to melt ice on the evaporator. Again, the length of the defrost period is fixed, as is the length of the running period.

3. In hot gas bypass defrost systems, hot refrigerant from the compressor outlet is diverted by a solenoid valve directly into the frosted evaporator to melt the ice. In this case too, the defrost period is initiated for a preset period every hour (e.g. 5 minutes).

SUMMARY OF THE INVENTION

An aim of the present invention may be viewed as being to improve the efficiency of existing dehumidifiers.

This invention is based on an appreciation that under a wide range of normal operating conditions, existing dehumidifiers do not run as efficiently as they might. For example, on the one hand, the length of the defrost period may be longer than is necessary for complete defrosting, and on the other hand, the defrost period may be insufficient for complete de-icing.

The present invention proposes a dehumidifier of the kind set forth which operates with alternating run and defrost periods, in which the length of the defrost period is varied in a predetermined relationship with sensed operating temperature.

If an inverse relationship exists between the sensed temperature and the defrost period, the deicing period will be reduced at higher operating temperatures when there will be reduced ice formation. However, a nonlinear relationship is preferred, such that the change in the defrost period between sensed temperatures of 0 and 10° C. is greater than the change between 10° and 20° C., for example.

Preferably, the defrost period is eliminated (i.e. reduced to zero) above a predetermined sensed temperature, above which there will be no ice formation in the evaporator.

The operating temperature may be sensed in a number of positions. For example, it is conceivable that the temperature of the condenser or evaporator could be used, e.g. by terminating the defrost period when the evaporator temperature rises above 0° C. In order to provide accurate and repeatable results however, it is preferred to sense the temperature of air passing through the dehumidifier, preferably the incoming air before it is cooled by the evaporator or heated by the condenser.

Although the temperature may be sensed at any time during the running or defrost periods, the length of the defrost period is preferably determined by the temperature at the end of the running period.

The efficiency of the dehumidifier can be further increased if the length of the running period is reduced at low operating temperatures, thereby reducing the thickness of any ice buildup. Although a progressive or multiple-stepped reduction in the length of the running period may take place, a single reduction will usually be sufficient. Preferably the length of the running period is determined by the sensed temperature at the start of the running period.

BRIEF DESCRIPTION OF THE DRAWINGS

The following description and the accompanying drawings referred to therein are included by way of non-limiting example in order to illustrate how the invention may be put into practice.

The drawing is a diagrammatic representation of a dehumidifier of the invention.

DETAILED DESCRIPTION OF THE DRAWINGS

The illustrated dehumidifier has a passive defrost phase, although the invention could be applied to dehumidifiers which employ other defrost methods.

A compressor 1 pumps refrigerant around a hermetically sealed circuit which includes evaporator coils 2 and a condenser 3. A refrigeration effect causes the evaporator to become cold and the condenser to become warm. A fan draws incoming air over the evaporator coils so that any moisture in the incoming air condenses on the evaporator 2. The condenser 3 is positioned between the evaporator 2 and the fan 4, so that the air passes over the condenser and is warmed before leaving the dehumidifier.

A drip tray 5 is mounted beneath the evaporator coils 2 to collect any water which runs off the evaporator and channel the water into a collecting vessel 6. A float-operated microswitch (not shown) is mounted in the collection vessel to switch off electrical power to the dehumidifier (e.g. fan and compressor) and prevent it from operating when the vessel 6 is full.

In accordance with the invention, a temperature sensor S is positioned in the incoming air flow to sense the temperature of the incoming air. The output signals from the sensor are fed to a microcontroller MC, which reads the sensed temperature at regular periods, e.g. once every minute. The microcontroller uses this information to control the compressor 1 such that the compressor operates in successive run periods, during which the evaporator 2 removes moisture from the incoming air as described above, separated by defrost periods in which the compressor is switched off but the fan 4 continues to run to draw relatively warm air over the evaporator 2 causing any ice thereon to melt.

The sensed temperature at the start of a run period determines the duration of the respective run period, as explained below. The temperature at the end of a run period determines the length of the following defrost period, as illustrated, by way of example, in Table 1.

TABLE 1

| Air Temp. (°C.) | Run period (min.s) | Defrost period (min.s) |
|---|---|---|
| 2.5 | 30 | 25 |
| 3.5 | 30 | 18 |
| 4.5 | 30 | 14 |
| 5.5 | 30 | 12 |
| 6.5 | 30 | 9 |
| 7.5 | 30 | 8 |
| 8.5 | 30 | 7 |
| 9.5 | 30 | 6 |
| 10.5–14.5 | 30 | 5 |
| 15.5–21.5 | 45 | 4 |
| Above 21.5 | Continuous | 0 |

Thus, the length of the run period is constant below about 15° C. but increases to a longer fixed period above this temperature when there will be less ice buildup and higher humidity levels will generally occur. At close to freezing point the length of the defrost period is a maximum since the incoming air will only defrost the evaporator slowly, but as the air temperature increases the length of the defrost period is gradually reduced. Only small reductions in the defrost period take place above about 10° C. and above 21.5° C. the dehumidifier operates continuously with no defrost since the temperature of the incoming air will always be high enough to prevent icing up of the evaporator.

It will be appreciated that the operating characteristics of the dehumidifier can be varied within the scope of the invention. For example, the dehumidifier may also operate according to the conditions set out in Table 2.

TABLE 2

| Air Temp. (°C.) | Run period (min.s) | Defrost Period (min.s) |
|---|---|---|
| <4.0 | - refer to text - | |
| 4–5 | 45 | 30 |
| 5–7 | 45 | 25 |
| 7–8 | 45 | 18 |
| 8–9 | 45 | 15 |
| 9–10 | 45 | 13 |
| 10–11 | 45 | 11 |
| 11–12 | 45 | 9 |
| 12–13 | 45 | 7 |
| 13–15 | 75 | 6 |
| 15–18 | 75 | 5 |
| 18–27 | 75 | 4 |
| Above 27 | Continuous | 0 |

Again, the length of the run period is constant below about 13° C. but increases to a higher constant figure above this temperature. When the sensed temperature falls below about 4° C. the temperature of the incoming air will not be high enough to achieve passive defrosting of the evaporator. In this case, the microcontroller will put the dehumidifier into a 30 minute defrost period and then shut down the dehumidifier altogether. The unit will only come back on when the sensed air temperature rises to about 5° C.

The length of the defrost period is a maximum around 4° to 5° C. but as the air temperature increases the length of the defrost period is gradually reduced by decreasing increments. Above 27° C. the dehumidifier operates continuously with no defrost since the temperature of the incoming air will be high enough to prevent icing.

In practice there may be a small discrepancy between the temperature of the sensor and the ambient air temperature.

The dehumidifier of the invention thus operates with a high level of efficiency for the following reasons:

a) When defrosting takes place, the dehumidifier is only inoperative for as long as is necessary for complete defrosting, irrespective of the incoming air temperature.

b) Defrost only takes place when the incoming air temperature is low enough to permit ice formation.

c) At low temperatures defrosting takes place more frequently (i.e. there is a shorter run period) so that the ice never becomes thick.

What I claim is:

1. A dehumidifier comprising a refrigerant circuit containing a refrigerant, a compressor for circulating the refrigerant around the refrigerent circuit, an evaporator which becomes cold, and a condenser which becomes warm; means for drawing air through the evaporator to pass over the evaporator followed by the condenser so that any moisture in the air condenses on the evaporator, following which the air is warmed by the condenser; means for sensing the operating temperature of the dehumidifier; and control means arranged to operate the compressor in accordance with the sensed operating temperature such that the dehumidifier operates with alternating run and defrost periods, in which the length of the defrost period is varied in a predetermined relationship with said sensed operating temperature.

2. A dehumidifier according to claim 1, in which the control means is arranged to produce a non-linear relationship between the sensed operating temperature and the length of the defrost periods.

3. A dehumidifier according to claim 2, in which the control means is arranged such that, for a given amount of change in operating temperature, the length of the defrost periods reduces with increasing operating temperature.

4. A dehumidifier according to claim 1, in which the control means is arranged such that the length of the defrost period becomes zero above a predetermined sensed operating temperature.

5. A dehumidifier according to claim 1, in which the means for sensing the operating temperature is arranged to sense the temperature of air passing through the dehumidifier.

6. A dehumidifier according to claim 5, in which the means for sensing the operating temperature is arranged to sense the temperature of incoming air before said air reaches the evaporator.

7. A dehumidifier according to claim 1, in which the control means is arranged such that the length of a defrost period is determined by the sensed operating temperature at the end of a preceding run period.

8. A dehumidifier according to claim 1, in which the control means is arranged such that the length of the run periods is reduced at low sensed operating temperatures.

9. A dehumidifier according to claim 1, in which the control means is arranged such that the length of each run period is determined by the sensed operating temperature at the start of the respective run period.

* * * * *